US007726621B1

(12) United States Patent
Dellinger

(10) Patent No.: US 7,726,621 B1
(45) Date of Patent: Jun. 1, 2010

(54) CONTAINER RESTRAINING DEVICE

(76) Inventor: Terry L. Dellinger, 908 Hampton Trail, Lilburn, GA (US) 30047

( * ) Notice: Subject to any disclaimer, the term of this patent is extended or adjusted under 35 U.S.C. 154(b) by 0 days.

(21) Appl. No.: 10/897,718

(22) Filed: Jul. 23, 2004

Related U.S. Application Data

(60) Provisional application No. 60/489,398, filed on Jul. 23, 2003.

(51) Int. Cl.
*A47B 91/00* (2006.01)

(52) U.S. Cl. ..... 248/346.5; 248/346.01; 220/737

(58) Field of Classification Search ..... 248/310, 248/311.2, 346.01, 346.11, 346.5; 220/737, 220/742, 571, 1, 628, 630; 366/349, 129; D32/54, 53, 53.1
See application file for complete search history.

(56) References Cited

U.S. PATENT DOCUMENTS

| | | | | | |
|---|---|---|---|---|---|
| 2,683,579 | A | * | 7/1954 | Wallace | 248/146 |
| 2,908,473 | A | * | 10/1959 | Snyder | 248/683 |
| 3,419,240 | A | | 12/1968 | Santic | |
| 3,831,209 | A | * | 8/1974 | Clingman | 441/136 |
| 4,726,553 | A | * | 2/1988 | Wischusen, III | 248/146 |
| 4,877,208 | A | | 10/1989 | Kennard | |
| 4,932,621 | A | * | 6/1990 | Kowk | 248/146 |
| 4,969,618 | A | | 11/1990 | Thompson | |
| D331,792 | S | * | 12/1992 | Wilcox | D23/206 |
| 5,232,188 | A | | 8/1993 | Troncone | |
| D379,022 | S | * | 4/1997 | Cuthbertson | D34/38 |
| D383,271 | S | * | 9/1997 | Eshelman | D32/54 |
| 5,813,643 | A | * | 9/1998 | Zybert | 248/310 |
| D416,764 | S | * | 11/1999 | Gagne | D7/619.1 |
| 6,039,206 | A | * | 3/2000 | DeFrancesco | 220/737 |
| 6,152,018 | A | * | 11/2000 | Yeh | 99/279 |
| 6,361,001 | B1 | | 3/2002 | Durand | |
| 6,571,976 | B1 | * | 6/2003 | Sonnabend | 220/483 |
| 6,837,401 | B2 | * | 1/2005 | Groys | 222/189.11 |
| 2003/0106158 | A1 | | 6/2003 | Roebuck | |
| 2003/0223306 | A1 | | 12/2003 | Foster | |
| 2004/0084599 | A1 | | 5/2004 | Tedesco et al. | |
| 2005/0045780 | A1 | * | 3/2005 | Forshee et al. | 248/146 |

* cited by examiner

*Primary Examiner*—A. Joseph Wujciak, III
(74) *Attorney, Agent, or Firm*—David L. Banner

(57) ABSTRACT

There is provided a substantially planar, resilient base adapted for receiving the lower portion of a circular pail containing a material needing stirring or mixing. A raised annular wall on the upper surface of the planar base encircles the circumference of the lower portion of the bucket thereby retaining the bucket. One or more radially projecting wings provide pads upon which the feet of the person stirring the bucket contents may be placed further securing the base to the floor or other surface. The resilient nature of the upwardly projecting, bucket encircling wall allows accommodating buckets of varying diameters.

15 Claims, 5 Drawing Sheets

CONTAINER RESTRAINING DEVICE

RELATED APPLICATION

This application claims priority in accordance with 35 U.S.C. §1.119(e) to U.S. Provisional Patent Application Ser. No. 60/489,398 filed Jul. 23, 2003.

FIELD OF THE INVENTION

The invention pertains to holding devices for pails or buckets and, more particularly, to a resilient base adapted for attachment to paint cans, buckets, or pails to prevent rotation during stirring the contents thereof.

BACKGROUND OF THE INVENTION

Painters, dry wall installers, and other craftspeople often rely on materials supplied in large pails or buckets, for example 3, 4.5 or 5 gallon round pails or buckets.

Materials include paint, varnish, dry wall "mud", stucco, coatings, grout, cements, etc. A common characteristic of such materials is that they must be stirred or otherwise mixed prior to their respective uses. Because of the typical viscosity of these materials, any attempt to stir or mix the bucket contents generally results in rotation of the container was well as the contents thereof.

Many makeshift arrangements have been used by craftspeople in an attempt to stop such container rotation. For example, a worker may sit and attempt to secure a bucket between his or her knees or legs. However, none have provided a satisfactory mechanism to prevent container rotation during stirring or mixing.

DISCUSSION OF THE RELATED ART

U.S. Pat. No. 3,419,240 for GARBAGE CAN PROTECTOR, issued Dec. 31, 1968 to William V. Santic provides an annular rubber base adapted for installation on the bottom of garbage or trash containers to deaden the sound and protect the garbage can bottom when the cans are roughly handled. The SANTIC apparatus features a pair of concentric, annular ridges adapted to trap a lower, projecting ridge at the bottom of a garbage can therebetween. Both ridges appear to have a rectangular cross-section. In addition, there are no projecting wings adapted to help prevent a garbage can placed in the SANTIC base from rotating.

The bucket restraining base of the invention, on the other hand, has a single upstanding ridge having a tapered cross section. Unlike the SANTIC apparatus, bucket retention is provided by an inner surface of the single upstanding, tapered wall acting against the outer surface of the retained bucket, not a projecting ridge on the bucket bottom. In addition, the bucket restraining base of the invention features radially projecting extensions or wings to further restrict rotation.

U.S. Pat. No. 4,877,208 for SUPPORT FOR MIXING BUCKETS, issued Oct. 31, 1989 to Edsel Kennard, Jr. teaches an apparatus for restraining a bucket during mixing. A raised, rigid platform having a circular opening adapted to receive and frictionally retain a bucket is provided. Non-skid material at the bottom and around the side of the circular opening act to prevent bucket rotation.

In comparison, the bucket restraining base of the invention is resilient and may, like a large rubber band, stretch to accommodate a variety of bucket size variations. The KENNARD Jr. Apparatus accommodates only a single bucket size.

U.S. Pat. No. 4,969,618 for CONTAINER HOLDER, issued Nov. 13, 1990 to Steve Thompson teaches an apparatus having foam-lined, upstanding sides and a plurality of radially projecting legs. The THOMPSON apparatus is adapted for supporting a container during transport and provides few, if any, features making the structure suitable for supporting a bucket during the mixing of its contents.

U.S. Pat. No. 5,232,188 for MIXING PAIL JIG, issued Aug. 3, 1993 to George Troncone teaches a metal jig for frictionally retaining a bucket. The bucket is retained by an interference fit between the bucket wall and the metal frame which becomes distorted by depressing attached pedals. The TRONCONE apparatus may be secured to a roof by a tack nail and is well suited for bucket retention on a slopped surface.

In contradistinction, the inventive bucket restraining base is formed from a resilient material, not metal, and features a bucket-encircling base with radially projecting wings upon which the worker stirring the bucket contents may stand.

U.S. Pat. No. 6,361,001 for CONTAINER HOLDER, issued Mar. 26, 2002 to Mark Roger Durand features a pair of legs having a one-piece top frame adjustably and slidably affixed thereto. The DURAND apparatus allows the one piece top portion to be raised or lowered to accommodate containers having differing heights.

The inventive bucket restraining base, however, is a one-piece, resilient structure having a substantially circular base which is adapted to encircle buckets of varying diameters. This is not possible with the DURAND apparatus.

Published United States Patent Application No., 2003/0106158 for BUCKET GRASP FOR SPIN RESISTANT MIXING, published Jun. 12, 2003 upon application by Philip J. Roebuck teaches a restraint device adapted to attach to a bail or handle of a bucket. The ROEBUCK apparatus curves downward to the floor when a worker's foot engages a non-skid portion thereof so as to prevent spinning the bucket to which the apparatus is attached.

The inventive bucket restraining base does not rely upon attachment to an easily pulled away or distorted wire bail or handle. In addition, the wings radially projecting from the base of the apparatus allow engagement with both feet of the workman stirring the bucket contents.

United States Published Patent Application No. 2003/0223306 for HOLDER FOR 5 GALLON BUCKET DURING MIXING, published Dec. 4, 2003 upon application by Charles D. Foster, Jr. teaches one such device. FOSTER Jr. provides a stand having a circular opening in a top receiving and frictionally retaining a 5 gallon bucket of a material requiring mixing or stirring. The top surface is large enough so that a person may stand thereupon to help secure the platform from rotating along with the bucket. The FOSTER JR. apparatus is cumbersome and does not appear to contain any mechanism for preventing the rotation of a bucket containing a particularly stiff material.

In contradistinction, the bucket restraining device of the present invention is small, portable, and inexpensive. Radial wings on the outer circumference are provided for accepting downward pressure directly from the feet of the person engaged in stirring the bucket contents. The resilient nature of the inventive apparatus causes translation of at least a portion of the rotational force transmitted by the bucket into a frictional force helping prevent spinning of the bucket within the restraining device.

Published United States Patent Application No. 2004/0084599 for FIVE GALLON BUCKET VISE, published May 6, 2004 upon application by Louis Samuel Tedesco et al. provides a complex mechanical apparatus having jaws movable upon a frame to secure and retain a bucket during mixing. A locking mechanism is provided to hold the movable jaws in position once the bucket is secured.

The inventive bucket restraining base is a one piece, resilient structure that overcomes the need for multi-part mechanical devices having moving parts, frames, locking devices, etc. Rather, the base-encircling resilient apparatus of the invention securely prevents bucket rotation through frictional engagement of the bucket and the floor surface upon which the bucket and the attached resilient base has been placed.

A commercially available device marketed under the trade name of The Mix Fix™ and available as Item No. 3424 from United States Plastic Corp. of Lima, Ohio provides a platform having a raised, annular structure which grasps a bucket. Two pads are provided upon which a worker may place his or her feet during a mixing operation. Because only two pads are provided, the worker may be required to adjust his or her position to be properly aligned with the single available position for using the Mix Fix apparatus. In addition, as the Mix Fix is made from solid, rigid plastic, it is bulky, prone to breakage, and more difficult to transport and store than the inventive bucket restraint base. The solid plastic construction may also lead to wedging the bucket within the recessed opening of the Mix Fix making bucket removal difficult upon completion of the mixing or stirring operation.

None of the patents or pre-grant publications taken individually or in any combination are seen to teach or suggest the novel resilient bucket retraining base of the instant invention.

SUMMARY OF THE INVENTION

In accordance with the present invention there is provided a substantially planar, resilient base adapted for receiving the lower portion of a circular pail containing a material needing stirring or mixing. A raised annular wall or ridge on the upper surface of the planar base encircles the circumference of the lower portion of the bucket thereby retaining the bucket. Radially projecting wings provide pads upon which the feet of the person stirring the bucket contents may be placed further securing the base to the floor or other surface. The resilient nature of the upwardly projecting, bucket encircling wall allows accommodating buckets of varying diameters and/or non-circular shapes.

It is therefore an object of the invention to provide a base for preventing rotation of a circular bucket or pail while the contents thereof are stirred or mixed.

It is another object of the invention to provide a base made from a resilient, floor and bucket-gripping material.

It is an additional object of the invention to provide a base having an upwardly projecting, bucket encircling resilient wall.

It is a further object of the invention to provide a base having an upwardly projecting, bucket encircling resilient wall which accommodates and retains buckets of varying diameters.

It is yet another object of the invention to provide a base which is substantially planar and has floor gripping wings projecting outward from around its perimeter.

It is an additional object of the invention to provide a base which is substantially planar and which has one or more radially projecting wings for stepping by the feet of the person stirring the bucket contents.

BRIEF DESCRIPTION OF THE DRAWINGS

A complete understanding of the present invention may be obtained by reference to the accompanying drawings when considered in conjunction with the subsequent detailed description, in which.

DESCRIPTION OF THE PREFERRED EMBODIMENT

The bucket restraining base of the invention is intended to stop rotation of a bucket while the contents thereof are being stirred or mixed. Paint, dry wall "mud", grout, mortar, adhesives, and may other liquids or semi-plastic substances are typically supplied in a variety of standard size, circular buckets or pails. In the United States marketplace, 3, 4.5 or 5 gallon circular pails or buckets are common. It will be recognized that other sizes, both larger and smaller, and shapes (e.g., oval) may also be found in the marketplace. The bucket restraining base of the present invention is designed and adapted to accommodate a wide variety of bucket sizes and shapes within, of course, the specific design parameters of a particular base embodiment. Consequently, the invention is not considered limited to use with a particular bucket size or shape. The term bucket is used hereinafter to indicate any similar container having a substantially circular cross section at a lower region thereof. Many aforementioned materials supplied in such buckets require stirring or mixing prior to their intended use. With low viscosity materials (e.g., thin stains or coatings), this generally presents little or no problem because the swirling contents transfer little energy to the bucket, energy which tends to cause the bucket to rotate in the same direction as the swirling contents. However, for materials having a higher viscosity (e.g., paint, mud, etc.), frictional engagement of the material mass with the bucket side and bottom walls may well impart enough energy to the bucket to cause bucket rotation. This is not only counterproductive from an energy point of view but it may lead to spilling the bucket contents. In the extreme case, the bucket contents may never become mixed if the contents and the bucket all merely rotate at the same speed.

Perhaps more importantly, devices and techniques of the prior art often present safety hazards. A worker standing on the bucket of material being mixed is a typical example. A sudden lurch or shudder of the bucket often causes the worker to fall with the attendant consequences of such a fall. The technique of securing the bucket between the knees or legs of the worker has reportedly caused leg or knee injury from the motion of the bucket against the worker's body. The bucket restraining base of the invention overcomes these problems leading to a safer workplace.

To effectively mix higher viscosity materials it is necessary, therefore, to somehow restrain the bucket so that the majority if not all the stirring energy supplied to the bucket contents cause effective mixing of the contents. The resilient bucket restraint of the present invention effectively solves this problem.

Figure 1:
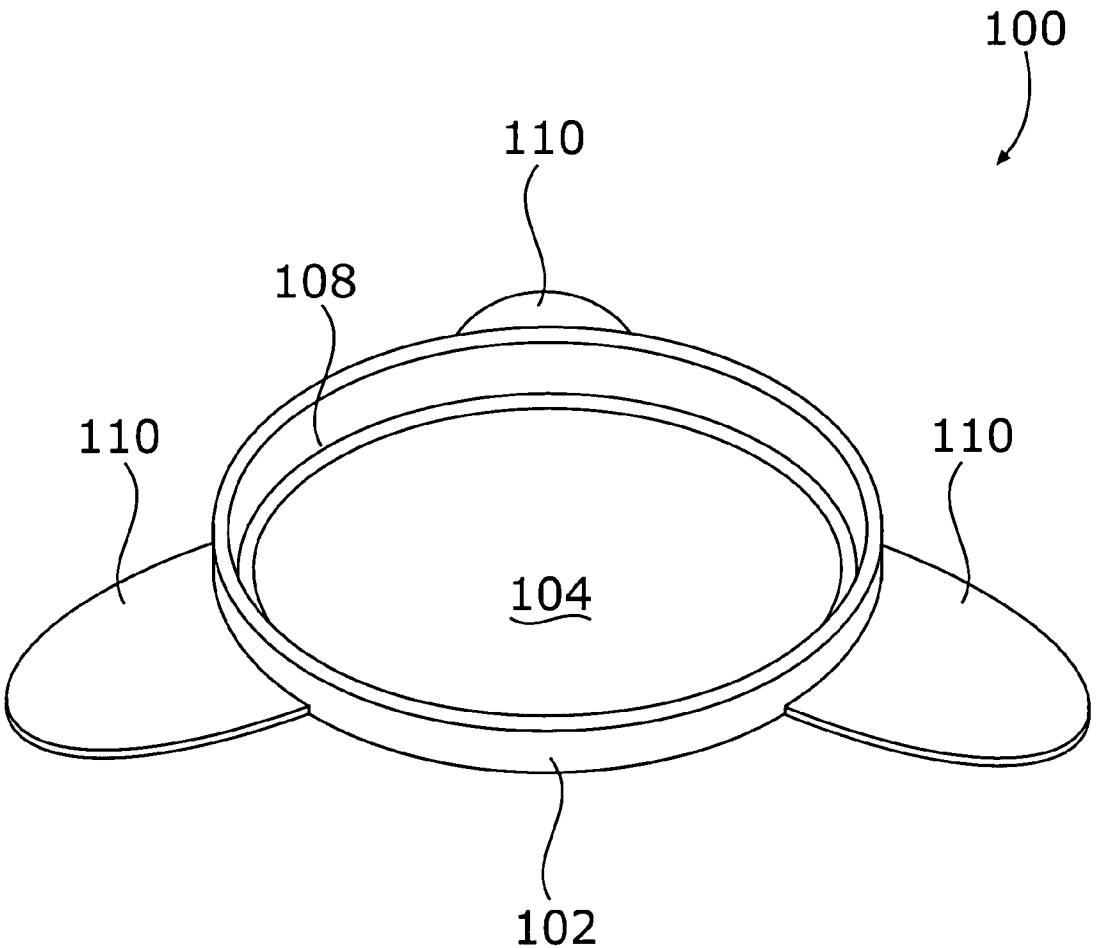
FIG. 1 is a perspective view of the bucket restraining base of the invention.
Figure 2:
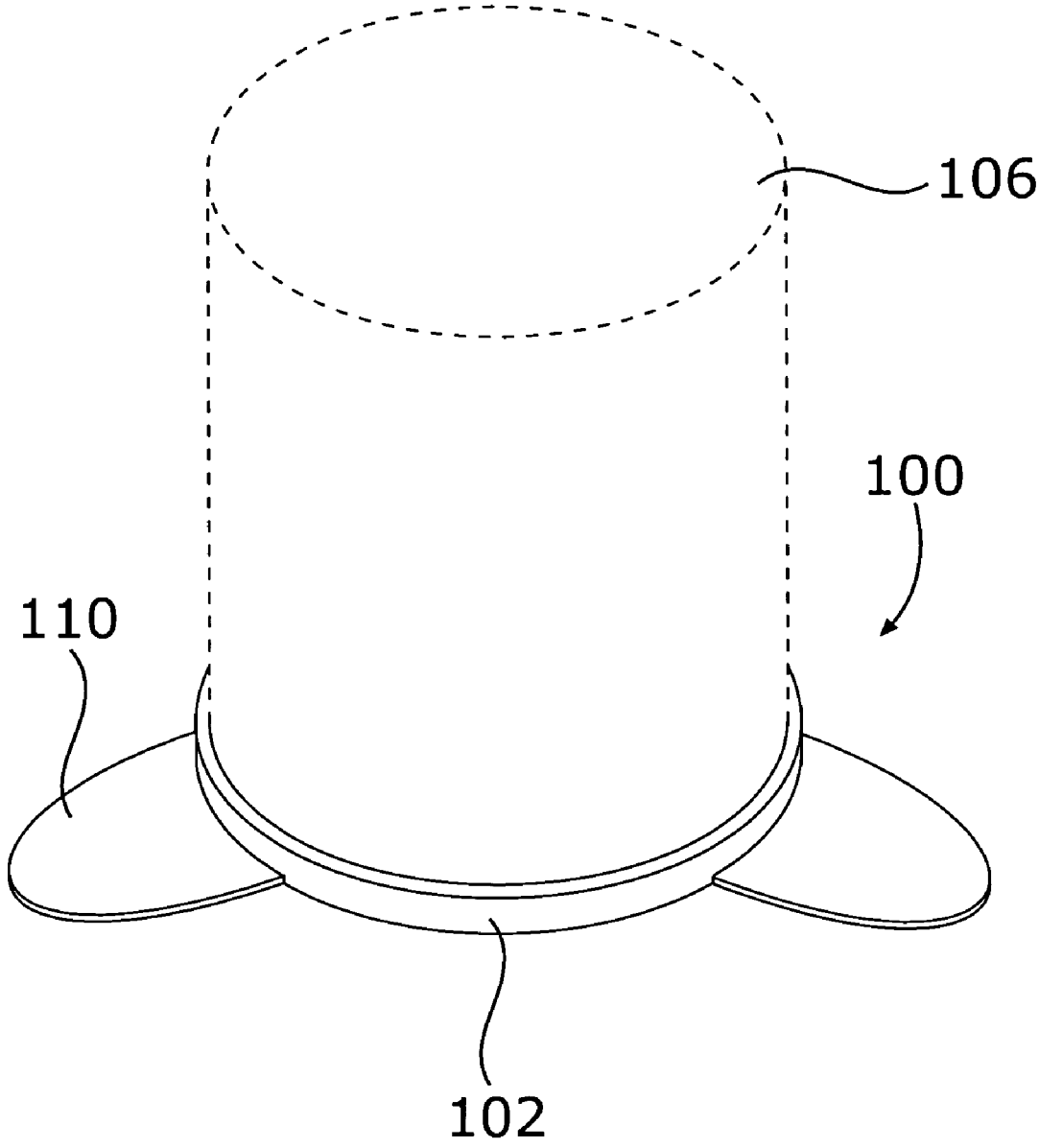
FIG. 2 is a perspective, environmental view of the bucket restraining base of FIG. 1 in its intended application.
Figure 3:
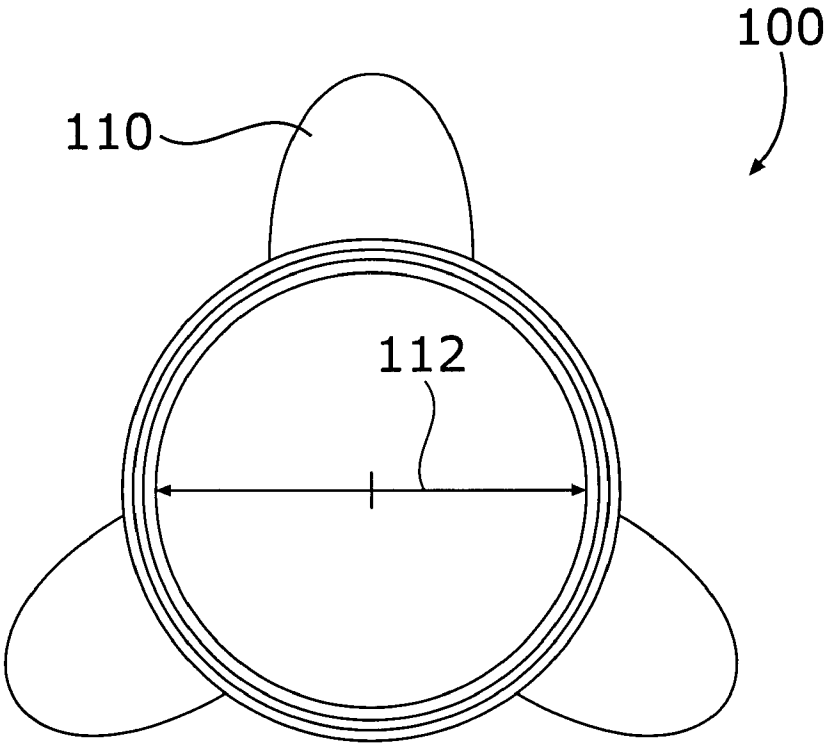
FIG. 3 is a top, planar view of the bucket restraining base of FIG. 1.
Figure 4:
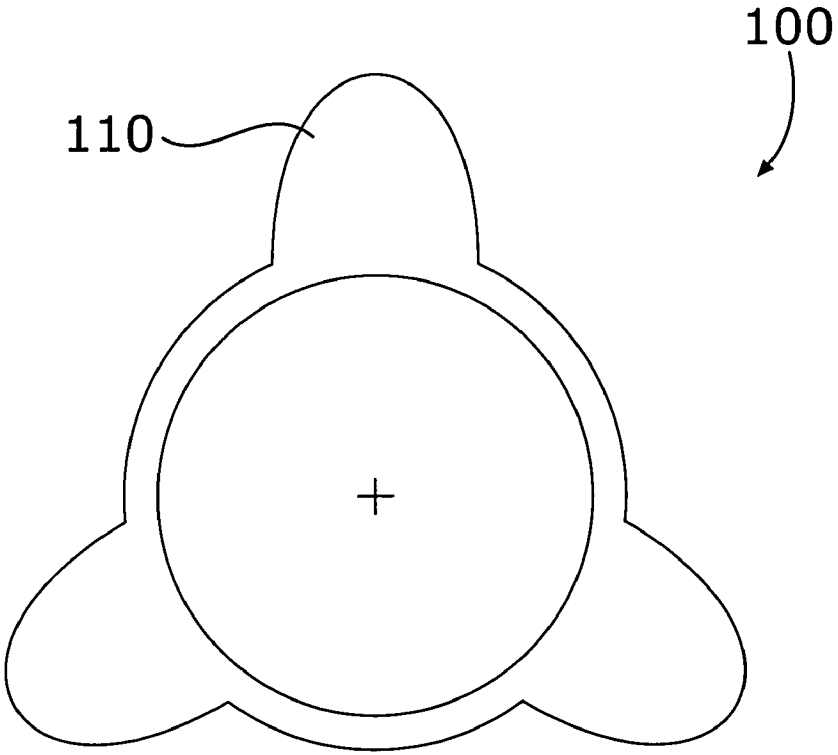
FIG. 4 is bottom plan view of the bucket restraining base of FIG. 1.
Figure 5A:
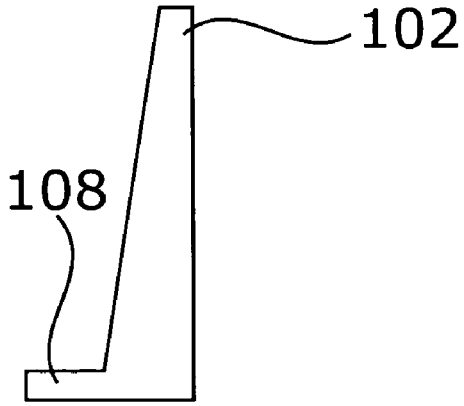
FIG. 5*a* is a first side cross-sectional view of the bucket restraining base of FIG. 1 in a non-wing region thereof.
Figure 5B:
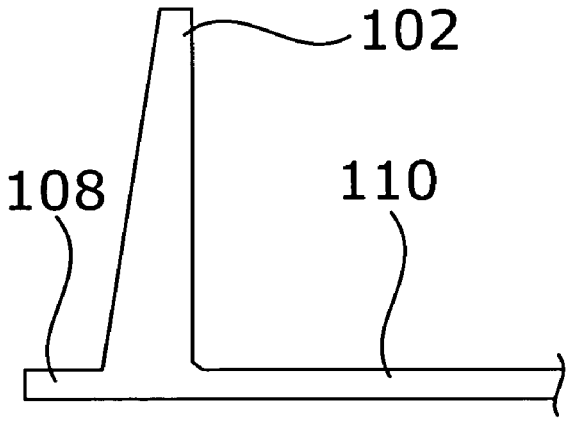
FIG. 5*b* is a second side cross-sectional view of the bucket restraining base of FIG. 1 in a wing region thereof.

Referring to FIGS. 1-5*b*, there are shown various views as enumerated hereinabove of the inventive bucket restraining base, generally at reference number 100. Base 100 has an open, annular structure comprising an upward projecting wall 102 having a tapered cross-sectional shape as may be seen in FIG. 5*a*. Central opening 104 has a diameter 112 (FIG. 3) selected to force a friction fit with bucket 106 (FIG. 2) when bucket 106 is inserted into central opening 104. A substantially circular lip 108 projects inwardly from the inside of upward projecting wall 102. Lip 108 provides additional contact with the bottom of bucket 106. However, lip 108 is optional and may be omitted in alternate embodiments of the invention. In alternate embodiments of the bucket restraining base 100, lip 108 could be extended further into the central opening 104 thereby increasing the surface in contact with the floor, not shown, or other surface upon which the bucket restrain base 100 is placed for use. In the ultimate case, lip 108 could become a full bottom surface completely closing the central opening 104 at the bottom of upward projecting wall 102.

One or more attachments or flangess or feet or wings 110 project radially outward from the outside, lower region of upward protecting wall 102. While three wings 110 are chosen for purposes of disclosure, other numbers and/or geometries of wings 110 may also be chosen. In an alternate embodiment, wings 110 may be replaced by a concentric annular flange projecting outward from the outer surface of upward protection wall 102. Three wings 110 displaced approximately 120 degrees from one another provide a natural geometry for the placement of a worker's feet, not shown, during a mixing operation. With three wings 110 as shown, a worker may approach bucket restraining base 100 from any direction and find two of the three wings 110 conveniently located for his or her feet with little or no positional adjustment of either the worker or the base 100.

Bucket restraining base 100 is typically a one piece molded structure made from an elastomer such as natural or artificial rubber or another elastomeric polymer, for example a polyvinyl elastomer. It will be recognized that a wide variety of elastomeric materials are available and the invention is not considered limited to the material chosen for purposes of disclosure. Rather, the invention is seen to encompass any suitable material. While molding has been chosen as one manner of forming the bucket restraining base 100 of the invention, it will also be recognized that another forming processes may be used to create the bucket restraining base 100 of the invention. Finally, while the bucket restraining base 100 is envisioned as a one piece structure, it may also be formed from multiple individual sections, not shown, formed into a final, unified structure.

The properties of the material from which bucket restraining base 100 is molded or otherwise formed significantly influence to its functionality. A wide range of elastomeric materials such as thermosetting polymers, thermoplastic polymers, rubbers, and silicone rubber may be used. Pliability or elasticity is important so that bucket restraining base 100 may stretch to accommodate variations in diameter and/or shape of the bucket 106 which is to be retained thereby. Consequently, bucket restraining base the inner diameter 112 is made somewhat smaller than the diameter of the smallest bucket 106 which is to be secured by bucket restraining base 100. The range of bucket diameters which may be accommodated by a single size of bucket restraining base 100 is, therefore, dependent upon the elasticity of the chosen material. Materials having a durometer in the range of approximately 20-90 Shore A have been found suitable for manufacturing the bucket restraining base 100 of the invention. It will be recognized that many blends of materials as well as di- and tri-polymers may form suitable materials for forming bucket restraining base 100

Second, a preferred material may exhibit a tacky or sticky surface useful for increasing the friction between the inner surface of upward projecting wall 102 and the outer surface of bucket 106 as well as between the lower surface of wings 110 and the floor or other surface upon which bucket restraining base 100 is placed.

The cross section for upward projecting wall 102 is chosen to provide several functions. First, pressure contact against the inner surface of upward projecting wall 102 and the outer surface of bucket 106 help prevent rotation of bucket 106. The softer (i.e., the lower the durometer of) the material from which bucket restraining base 100 is formed, the more energy may be absorbed by upward projecting wall 102.

It will recognized that the inventive bucket restraining base 100 may be provided in a range of sizes to accommodate both larger and smaller buckets 106 than the 3.5-5 gallon range chosen for purposes of disclosure.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed:

1. A support base for a bucket comprising:

a) a resilient, annular, continuous, upstanding wall having a tapered cross-sectional shape, said taper being substantially continuous from a top of said upstanding wall to a bottom thereof, said upstanding wall comprising a sloping inner, upright surface that is devoid of vertical, outward projections, a predetermined uniform height, and a continuous, flat, uninterrupted bottom surface devoid of annular concentric grooves and adapted for frictional interaction with an environmental supporting surface therebeneath, said upstanding wall defining and completely surrounding a central, substantially circular opening having a diameter substantially equal to a distance between two diametrically opposed points on said inner, upright surface of said upstanding wall and sized to accept a lower region of an outer vertical surface of a substantially cylindrical bucket having a predetermined outside diameter, thereby allowing frictional engagement of said lower region of said outer vertical surface of said bucket by and with said inner surface of said upstanding annular wall, said opening exposing said environmental supporting surface when said support base is resting thereupon and no bucket is retained thereby; and b) at least one substantially flat, horizontally oriented, planar wing having a substantially flat top surface being substantially parallel to a flat, uninterrupted bottom surface thereof and being rigidly affixed to and projecting radially outward from a lower, outside edge of said annular wall, said at least one wing having a continuous bottom surface devoid of depressions or grooves and being contiguous with said bottom surface of said annular wall, said continuous, uninterrupted bottom surface also being adapted for frictional interaction with said environmental supporting surface, said at least one wing being adapted to receive a human foot on an upper surface thereof, said upper surface being substantially parallel to said continuous bottom surface;

whereby said bucket is restrained from rotary motion by said frictional engagement of said outer surface of said vertical surface of said bucket when contents thereof are stirred.

2. The support base for a bucket as recited in claim 1, wherein said upstanding annular wall comprises at least one of the cross-sectional shapes: a substantially trapezoidal cross section, and a substantially triangular cross section.

3. The support base for a bucket as recited in claim 1, wherein said upstanding annular wall and said at least one outwardly projecting wing comprises a resilient material.

4. The support base for a bucket as recited in claim 3, wherein said resilient material comprises at least one of the materials: an elastomeric polymer, natural rubber, synthetic rubber, silicone rubber, thermoplastic polymer, and thermosetting polymer.

5. The support base for a bucket as recited in claim 4, wherein said resilient material has a durometer in the range of approximately 20-90 Shore A.

6. The support base for a bucket as recited in claim 1, wherein said at least one wing projecting radially outward from a lower, outside edge of said annular wall comprises three wings.

7. The support base for a bucket as recited in claim 1, wherein said at least one wing projecting radially outward in a horizontal plane from a lower, outside edge of said annular wall comprises a substantially circular, concentric, continuous, uninterrupted wing comprising a flat bottom surface disposed adjacent a lower, outer edge of said annular wall, and a flat top surface parallel to said bottom surface.

8. The support base for a bucket as recited in claim 1, further comprising:

c) a substantially circular lip projecting inward into said central opening from a lower, inside surface of said annular wall;

wherein said circular opening has a diameter substantially equal to a distance between two diametrically opposed points on an innermost edge of said substantially circular lip.

9. The support base for a bucket as recited in claim 8, wherein said upstanding annular wall comprises at least one of the cross-sectional shapes: a substantially trapezoidal cross section, and a substantially triangular cross section.

10. The support base for a bucket as recited in claim 8, wherein said upstanding annular wall and said at least one outwardly projecting wing comprises a resilient material.

11. The support base for a bucket as recited in claim 10, wherein said resilient material comprises at least one of the materials: an elastomeric polymer, natural rubber, synthetic rubber, silicone rubber, thermoplastic polymer, and thermosetting polymer.

12. The support base for a bucket as recited in claim 11, wherein said resilient material has a durometer in the range of approximately 20-90 Shore A.

13. The support base for a bucket as recited in claim 8, wherein said at least one wing projecting radially outward from a lower, outside edge of said annular wall comprises three wings.

14. The support base for a bucket as recited in claim 8, wherein said at least one wing projecting radially outward from a lower outside edge of said annular wall comprises a substantially circular, concentric, continuous, uninterrupted wing disposed adjacent a lower, outer edge of said annular wall.

15. A support base for a five gallon bucket comprising:

a) a resilient, annular, upstanding wall having a tapered cross-sectional shape, said taper being substantially continuous from a top of said upstanding wall to a bottom thereof, said upstanding wall comprising a sloping inner upstanding surface that is devoid of vertical, outward projections, a predetermined uniform height and a continuous, flat uninterrupted, bottom surface devoid of annular concentric grooves, said upstanding wall defining and completely surrounding a central, substantially circular opening having a diameter substantially equal to a distance between two diametrically opposed points on said inner, upright surface of said upstanding wall and sized to accept a lower region of an outer vertical surface of said five gallon bucket; and b) three substantially horizontally oriented planar wings, each having a substantially flat top surface being substantially parallel to a flat, uninterrupted bottom surface thereof and being rigidly affixed to and projecting radially outward from a lower, outside edge of said annular wall, said three substantially horizontal wings having a continuous bottom surface devoid of depressions or grooves and being contiguous with said bottom surface of said annular wall, said three wings each being adapted to receive a human foot on an upper surface thereof, said upper surface being substantially parallel to said continuous bottom surface;

whereby, rotation of said five gallon bucket is minimized as the contents thereof are stirred.

* * * * *